US005103458A

United States Patent [19]

Soykan

[11] Patent Number: 5,103,458

[45] Date of Patent: Apr. 7, 1992

[54] ELECTRIC ARC REMELTING

[75] Inventor: Ferhun H. Soykan, New Hartford, N.Y.

[73] Assignee: Special Metals Corporation, New Hartford, N.Y.

[21] Appl. No.: 667,148

[22] Filed: Mar. 11, 1991

[51] Int. Cl.[5] ..... H05B 7/07

[52] U.S. Cl. ..... 373/67; 373/20; 373/68; 373/69; 373/70; 373/72; 373/94; 164/497

[58] Field of Search ..... 373/67, 68, 69, 70, 373/76, 77, 15, 62, 65, 97, 105, 106, 85, 18, 20, 94, 99, 101, 72, 107; 219/125.12; 164/52

[56] References Cited

U.S. PATENT DOCUMENTS

| | | | |
|---|---|---|---|
| 2,782,245 | 2/1957 | Preston | 373/67 |
| 3,080,499 | 3/1963 | Cooper | 373/67 |
| 3,379,238 | 4/1968 | Sieckman | 373/67 |
| 3,384,777 | 5/1968 | Sennewald et al. | 373/94 |
| 3,393,264 | 7/1968 | Wynne | 373/67 |
| 3,393,266 | 7/1968 | Wynne | 373/67 |
| 3,420,939 | 1/1969 | Schlienger | 373/90 |
| 3,461,214 | 8/1969 | Schlienger | 373/90 |
| 3,597,519 | 8/1971 | Kemeny | 373/85 |
| 3,683,094 | 8/1972 | Schlienger | 373/107 |
| 3,759,311 | 9/1973 | Jackson | 164/52 |
| 3,920,062 | 11/1975 | Soykan et al. | 373/106 |
| 4,261,412 | 4/1981 | Soykan et al. | 164/469 |
| 4,295,031 | 10/1981 | Roen | 219/125.12 |
| 4,569,056 | 2/1986 | Veil | 373/70 |
| 4,637,032 | 1/1987 | Whitman | 373/69 |
| 4,670,884 | 6/1987 | Letizia et al. | 373/101 |
| 4,912,296 | 3/1990 | Schlienger | 373/18 |

OTHER PUBLICATIONS

"Macrosegregation in Rotated Remelted Ingots," S. Kou, D. Poirier, M. Flemings; Met. Trans. B; vol. 9B; Dec. 1978, pp. 711-719.

*Primary Examiner*—Bruce A. Reynolds
*Assistant Examiner*—Tu Hoang
*Attorney, Agent, or Firm*—Robert F. Dropkin

[57] ABSTRACT

A process for casting an ingot of pre-alloyed metal from a consumable electrode. It includes the steps of: providing a consumable electrode corresponding to the desired metallurgical composition of the to-be-cast ingot; providing a second electrode; striking an arc between the consumable electrode and the second electrode to melt the consumable electrode and thereby form a molten pool; maintaining the arc between the consumable electrode and the molten pool; rotating or oscillating the consumable electrode about its axis during melting; providing a controlled atmosphere for the melting of the consumable electrode; delivering molten metal into a fluid cooled mold; and withdrawing the ingot from the mold.

4 Claims, 1 Drawing Sheet

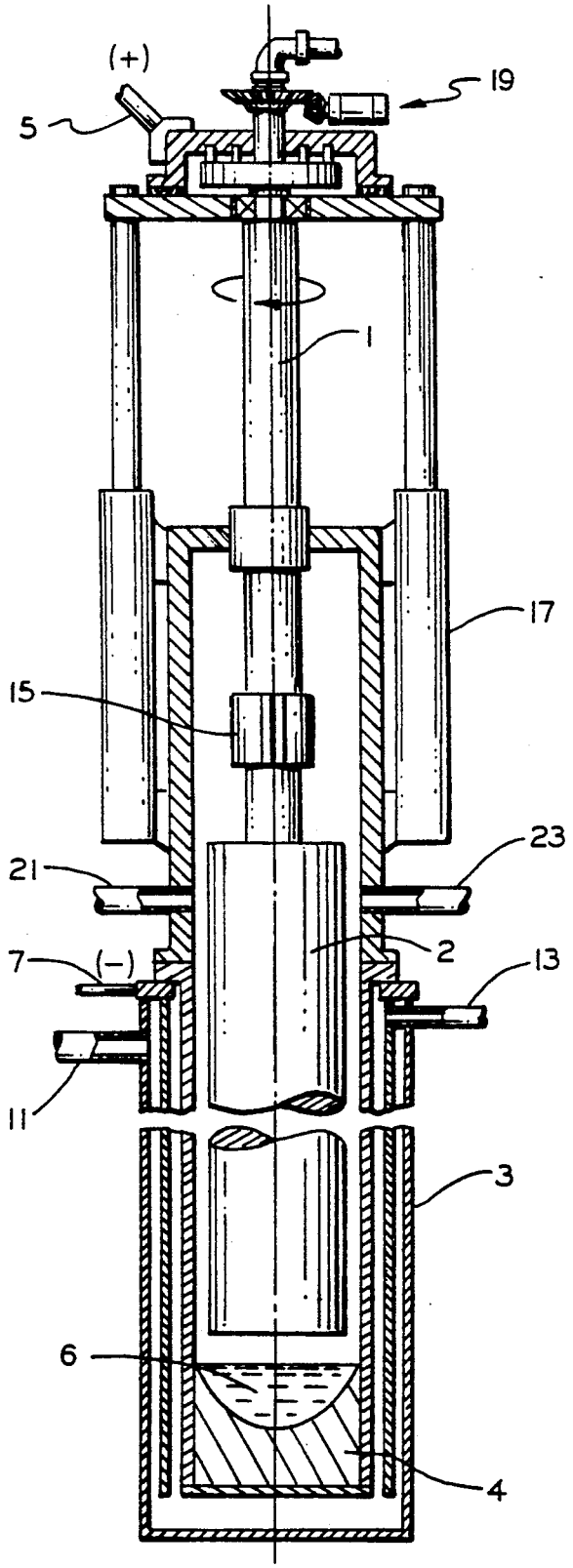
(+)
5
19
1
17
15
23
21
2
7
(-)
13
11
3
6
4

ELECTRIC ARC REMELTING

The present invention relates to a process for casting an ingot of pre-alloyed metal supplied from a consumable electrode.

Vacuum arc remelting is a well known and utilized process for casting an ingot of pre-alloyed metal from a consumable electrode. It is a process which is particularly suited for the production of ingots of segregation sensitive materials. One class of these materials are the nickel-base superalloys used in aircraft gas and land gas turbines These alloys have relatively large amounts of reactive and refractory elements. Purification of these alloys occurs during vacuum arc remelting by deoxidation, degasification and dissociation of undesirable compounds.

It has been observed, that the arc which is maintained between the consumable electrode and a molten pool during vacuum arc melting, is at times not diffused and evenly distributed. The arc has been observed to become constricted at a particular location between the electrode surface and adjacent molten pool. Constriction causes localized melting which results in uneven and unfavorable solidification patterns. Constriction is believed to push floating nonmetallic particles to localized zones wherein they become trapped within the solidified ingot.

The present invention provides a process which lessens the problems associated with constricted arcs. The consumable electrode is rotated or oscillated about its axis during melting. The energy distributed to the molten pool becomes spread out a do the metal droplets regardless of the presence of arc constriction. Rotation can, moreover, be controlled so as to distribute molten droplets at a predetermined rate.

A number of references disclose means for rotating or oscillating an electrode. These references include the following U.S. Pat. Nos.:

| | |
|---|---|
| 3,384,777 | 3,920,062 |
| 3,393,264 | 4,261,412 |
| 3,420,939 | 4,637,032 |
| 3,461,214 | 4,670,884 |

and an article entitled, "Macrosegregation in Rotated Remelted Ingots". The article appears on pages 711–719 of Metallurgical Transactions, Volume 9B, December, 1978.

The present invention is not disclosed in any of the hereinabove cited references. U.S. Pat. Nos. 3,384,777; 3,420,939; 3,461,214; and 4,670,884 do not pertain to a process for casting an ingot of pre-alloyed metal supplied from a consumable electrode. U.S. Pat. No. 3,393,264 merely refers to a means for moving an electrode into position for melting. U.S. Pat. Nos. 3,920,062 and 4,261,412 do not disclose a process wherein an arc is maintained between a rotating or oscillating consumable electrode and a molten pool. U.S. Pat. No. 4,637,032 merely discloses a rotary seal for a movable shaft. The article from Metallurgical Transactions refers to a rotating mold.

It is accordingly an object of the present invention to provide an improved process for casting an ingot of pre-alloyed metal supplied from a consumable electrode.

The foregoing and other objects of the invention will become apparent from the following detailed description taken in connection with the accompanying drawing in which the single FIGURE is a diagrammatic view of an arc furnace incorporating a principal embodiment of the present invention.

The present invention provides a process for casting an ingot of pre-alloyed metal from a consumable electrode It comprises the steps of: providing a consumable electrode corresponding to the desired metallurgical composition of the to-be-cast ingot; providing a second electrode; striking an arc between the consumable electrode and the second electrode to melt the consumable electrode and thereby form a molten pool; maintaining the arc between the consumable electrode and the molten pool; rotating or oscillating the consumable electrode about its axis during melting; providing a controlled atmosphere for the melting of the consumable electrode; delivering molten metal into a fluid cooled mold; and withdrawing the ingot from the mold. The consumable electrode is rotated or oscillated about its axis during melting to lessen the problems associated with constricted arcs. Constriction causes localized melting which results in uneven and unfavorable solidification patterns. Constriction is believed to push floating nonmetallic particles to localized zones wherein they become trapped within the solidified ingot.

Although the present invention may be used for many different alloys, it is particularly suited for the production of ingots of segregation sensitive alloys. One class of these alloys are the nickel-base superalloys used in aircraft gas and land gas turbines. These alloys typically contain at least 55% nickel.

An embodiment of apparatus used to perform the process of the present invention is shown in the FIGURE. It comprises ram 1 which is connected to consumable electrode 2, fluid cooled mold 3 containing solidified ingot 4 and molten pool 6, electrical power input connector 5, electrical power output connector 7, coolant fluid inlet 11, coolant fluid outlet 13, electrode stub clamp 15, hydraulic cylinders 17 for raising and lowering consumable electrode 2, hydraulic motor 19 to rotate ram 1 and consumable electrode 2, vacuum pump line 21 and inert gas supply line 23.

Hydraulic cylinders 17 adjust the height of consumable electrode 2 to obtain proper spacing for passing an electric arc. Current is passed through connectors 5 and 7 in order to strike an arc and melt consumable electrode 2. A controlled atmosphere is created through conventional means. Vacuum pumps may be used in conjunction with vacuum pump line 21 to create a subatmosphere pressure. A nonreactive gas may be supplied through inert gas supply line 23.

It will be apparent to those skilled in the art that the novel principles of the invention disclosed herein will suggest various other modification and applications of the same. It is accordingly desired that in construing the breadth of the appended claims that they shall not be limited to a specific embodiment of the invention as described herein.

I claim:

1. In a process for casting an ingot of pre-alloyed metal supplied from a consumable electrode, which process includes the steps of: providing a consumable electrode of pre-alloyed metal; providing a second electrode; striking an arc between said consumable electrode and said second electrode to melt said consumable electrode and thereby form a molten pool and an arc between said consumable electrode and said molten pool; maintaining said arc between said consumable electrode and said molten pool; providing a controlled atmosphere for the melting of said consumable electrode; delivering molten metal into a fluid cooled mold and casting an ingot of said metal; and withdrawing said ingot from said mold; the improvement comprising the steps of rotating said consumable electrode about its axis during melting.

2. The process according to claim 1, wherein said pre-alloyed metal is a nickel-base alloy.

3. In a process for casting an ingot of pre-alloyed metal supplied from a consumable electrode, which process includes the steps of: providing a consumable electrode of pre-alloyed metal; providing a second electrode; striking an arc between said consumable electrode and said second electrode to melt said consumable electrode and thereby form a molten pool and an arc between said consumable electrode and said molten pool; maintaining said arc between said consumable electrode and said molten pool; providing a controlled atmosphere for the melting of said consumable electrode; delivering molten metal into a fluid cooled mold and casting an ingot of said metal; and withdrawing said ingot from said mold; the improvement comprising the step of oscillating said consumable electrode about its axis during melting.

4. The process according to claim 3, wherein said pre-alloyed metal is a nickel-base alloy.

* * * * *